United States Patent [19]

Law

[11] Patent Number: 4,610,763

[45] Date of Patent: Sep. 9, 1986

[54] ELECTRODEPOSITION OF CHROMIUM AND CHROMIUM BEARING ALLOYS

[75] Inventor: Malcolm J. Law, Dorking, United Kingdom

[73] Assignee: Inter Metals and Minerals, S.A., Panama, Panama

[21] Appl. No.: 759,611

[22] PCT Filed: Apr. 1, 1985

[86] PCT No.: PCT/GB85/00135

§ 371 Date: Jul. 19, 1985

§ 102(e) Date: Jul. 19, 1985

[87] PCT Pub. No.: WO85/04677

PCT Pub. Date: Oct. 24, 1985

[30] Foreign Application Priority Data

Apr. 7, 1984 [GB] United Kingdom ..... 8409073

[51] Int. Cl.[4] ..... C25D 3/56; C25D 5/12; C25D 5/48

[52] U.S. Cl. ..... 204/35.1; 204/41; 204/43.1; 420/428; 428/632; 428/667

[58] Field of Search ..... 204/43.1, 35.1, 41, 204/38.4, 38.1; 428/667, 632

[56] References Cited

U.S. PATENT DOCUMENTS

| | | | |
|---|---|---|---|
| 2,927,066 | 3/1960 | Schaer | 204/43.1 |
| 2,990,343 | 6/1961 | Safranek | 204/43.1 |
| 3,093,556 | 6/1963 | Machu et al. | 204/44.5 |
| 3,917,517 | 11/1975 | Jordan et al. | 204/43.1 X |
| 3,954,574 | 5/1976 | Gyllenspetz et al. | 204/43.1 X |
| 4,142,948 | 3/1979 | Tajima et al. | 204/43.1 |

FOREIGN PATENT DOCUMENTS

| | | | |
|---|---|---|---|
| 31120 | 3/1980 | Japan | 204/43.1 |
| 15556 | 3/1983 | Japan | 204/43.1 |

OTHER PUBLICATIONS

WO 82/03095, Published 16 Sept. 1982, 204/43.1.
Chemical Abstracts, vol. 91, p. 580, 184047d, (1979).

*Primary Examiner*—G. L. Kaplan
*Attorney, Agent, or Firm*—Murray and Whisenhunt

[57] ABSTRACT

A coating on a substrate e.g., mild steel providing high corrosion resistance consists of a first coating of nickel on which is electrodeposited an alloy consisting of 51 to 75% chromium, 5 to 15% nickel and/or cobalt and balance iron.

8 Claims, No Drawings

ELECTRODEPOSITION OF CHROMIUM AND CHROMIUM BEARING ALLOYS

The present invention relates to the deposition of corrosion resistant alloys on electrically conductive substrates.

Various reports have appeared in literature relating to electrodeposition of chromium bearing alloys, e.g.:

'Iron-Nickel-Chromium Baths' by Larissa Domnikov, Metal Finishing March 1964 pp. 61–65

'Iron-Chromium-Nickel Alloy Deposition' by S. Gowri, P. L. Elsie and B. A. Shenoi., Metal Finishing December 1967 pp. 67–70.

'Stress in Electrodeposited Alloys' by W. H. Cleghorn, S. Gowri, P. L. Elsie, and B. A. Shenoi, Metal Finishing August 1969 pp. 65–71

'Deposition of Stainless Steel from Chloride Bath' by Larissa Domnikov, Metal Finishing February 1970 pp. 57–63

'Stress in Chromium-Nickel-Iron Alloy Deposits' by S. Gowri and B. A. Shenoi Metal Finishing June 1972 pp. 30–34

'Electrodepositioning Iron-Chromium-Nickel Alloys' by M. Sarojamma and T. L. Rama Char Metal Finishing September 1972 pp. 36–42.

We have also tested electroplating according to the baths used by Gowri and others and by Chisholm and Carnegie with resultant coatings having severe defects such as poor adhesion and non-uniformity of deposit and discolouration of deposit.

Various patents also relate to electrodeposition of chromium bearing alloy viz: U.S. Pat. Nos. 2766196, 2990343, 2927066, 3093556, 3795591, 3888744, 3374156, 3092556, 4141803 and 4142948 and UK 830205, 914866, 912950, 1149011.

We have carried out carefully documented tests on many such processes but have been unable to obtain satisfactory results especially from appearance, corrosion resistance and adhesion to the substrate.

In spite of all these efforts extending over many years, and in spite of the obvious advantages if a successful process could be developed, none of these efforts have been introduced into commercial production due to all the defects such as surface finish, adhesion and macrocracking.

Electroplating chromium (as distinct from chromium bearing alloys) has, of course, been commercially successful. However, all (except a few as mentioned hereafter) commercial chromium electroplating has been effected with baths based on hexavalent chromium compounds. This has considerable disadvantages which do not arise when using trivalent chromium compounds. Thus with hexavalent compounds the bath must be used at a much higher temperature e.g. 40°–60° C., than with trivalent chromium compounds and this gives rise to fumes and spray which can be exceedingly harmful to operators. However, the use of trivalent compounds has heretofore involved disadvantages especially the strong tendency to produce discoloured or striped coatings and undue lack of tolerance to contaminating ions e.g., Fe, Ni, Cu, Zn, in the bath which may arise from articles being coated and/or from carry-over from pre-plating or pre-treatment baths. Furthermore, internal stress of deposits when using trivalent chromium compounds for alloy deposition are greater than when using hexavalent compounds so that there is a greater tendency towards macrocracking. Microdiscontinuities have advantages compared with macrocracking e.g. improves corrosion resistance and accordingly it is very desirable to achieve coatings with microdiscontinuities e.g. at least 250 cracks per linear cm as defined in British Standard 1224 or pores of 10000 per 100 mm sq. The use of trivalent chromium also has the advantage that the bath can be effective with much lower concentrations of chromium than is required with hexavalent chromium compounds which is much better for various reasons e.g. disposal of effluent. Also with hexavalent chromium compounds a temporary break in current supply produces grey deposits which does not occur when using trivalent chromium compounds. With hexavalent chromium compounds also the degree of current density is much more critical than with trivalent.

A process for electrodepositioning a fine grained nickel coating is described in British Specification No. 936172 (Canada Pat. No. 689276) in which the bath contains finely divided inert particles which produces microporosity when subsequently covered with a thin coating of chromium which has "a favourable porosity pattern".

With the deposition of iron-chromium and iron-chromium nickel alloys there have been numerous patents and papers relating to this subject but there is not a commercially desirable process for the deposition of chromium alloys marketed based on baths containing trivalent chromium. In the case of trivalent chromium a process is proposed based on technology developed by Albright & Wilson Limited a British Company. One such process is described in their U.S. Pat. No. 3,954,574. However, this process is extremely sensitive to metallic contamination of Nickel, Copper, Iron and Zinc. The degree of sensitivity can be seen by reference to Albright & Wilson British Pat. No. 1,558,760. In the example (1) given in this patent it states a defect was showing on the chromium deposit when the electrolyte had trace metals in solution of Nickel 134 ppm, Copper 13 ppm, Iron 193 ppm, Zinc 26 ppm. The defect was diagnosed from previous experience as being due to the iron and nickel contamination. Contamination of trivalent chromium with these metals is such a problem that there is the development of British Pat. No. 1,558,760 which covers the use of a water soluble ferro-cyanide to treat the electrolyte to eliminate the contamination. There is also British Pat. No. 1,558,769 which covers the development of a test procedure to check for 'free' Ferrocyanide in trivalent chromium electrolytes as this can be detrimental. The degree of tolerance to these metals is shown on the technical instruction issued with the Albright & Wilson Trivalent Chromium process marketed as Alecra III. These they state as Copper-Maximum Tolerance 20 ppm, Zinc-Maximum Tolerance 50 ppm, Nickel-Maximum Tolerance 200 ppm, Iron-Maximum Tolerance 500 ppm. Tolerances of each metal contaminant is reduced by presence of other contaminant metals. Bath will not tolerate 200 ppm Nickel and 500 ppm of Iron.

We have carried out continuous intensive research extending over a period of several years and as a result we have evolved a process according to this invention that can be used on a commercial basis for the production of chromium alloy coatings. The process of the present invention provides electrodeposited coatings of consistent attractive appearance over the entire surface of a variety of articles of different shapes, with good adhesion to the substrate, good corrosion resistance, good bath tolerance to metallic contamination, low bath temperature and low process times. The baths have excellent tolerance to the two most common contaminent metals i.e. nickel and iron as they are a basic requirement of the electrolyte. Nickel comes from carry over of electrolyte from the preceding nickel plating process; iron from dissolved components that have fallen from plating racks during chromium plating and from metal dissolved from unplated areas e.g. inside of tubular components.

The use of complexants also involves problems. For example, most complexants have a preferential complexing effect on one or other of the metals Cr, Fe, Ni, Co. Also the complexing efficiency varies considerably with the variation of pH values of the bath. Selection of suitable complexants also affects the composition of the electrodeposited coating and the extent to which a desired composition can be maintained over the range of current densities which is encountered in commercial electroplating. Furthermore difficulties arise because of variation in the composition of the electrodeposited coating over the area of each plated article so that one area may be much less corrosion resistant than other areas.

We have made many experiments with electrodeposited alloys containing over 50% iron together with chromium and nickel of various proportions but have, like other experimenters, experienced great difficulties in meeting all the requirements necessary for a commercial operation. The alloys have a high internal stress which leads to macrocracking and corrosion and have a wide composition variation with variation of pH and current density.

We have now discovered a process whereby all these difficulties are overcome at least to such an extent that a very effective electroplating can be effected on a commercial scale.

According to the present invention the substrate is provided with a nickel coating upon which is electrodeposited an alloy consisting of 51 to 75% chromium, 5 to 15% nickel and/or cobalt, and balance iron. A preferred chromium alloy composition is chromium 55–65%, nickel 6–10%, balance Fe.

We have found that such a composition has a low internal stress and very good corrosion resistance and can be maintained over the whole area of a wide variety of shapes and sizes of articles notwithstanding wide variation of current density of a pH of 1.5 to 3.0 and a bath temperature of 18° to 35° C.

The composition of the chromium bearing electrolyte must be selected so as to deposit the required composition of the electrodeposited coating and should contain suitably selected complexing material to complex all the metal ions in solution.

The nickel coating may be single layer of nickel or a composite layer e.g. a layer of columnar type nickel produced from a sulphur-compound-free bath followed by a layer of lamellar nickel produced from an electrolyte containing a sulphur compound. Suitable electrolytes are disclosed in UK patent specification No. 1485665.

| EXAMPLE 1 | |
|---|---|
| Ammonium Chloride | 100 g/l |
| Boric Acid | 30 g/l |
| Chromium chloride (Cr as metal) | 20 g/l |
| Nickel sulphate | 3 g/l |
| Ammonium sulphate | 30 g/l |
| Ferrous Ammonium sulphate | 3.5 g/l |
| Oxalic Acid | 50 g/l |
| pH 2.5 | |
| Temperature 25° C. | |
| Current Density 200 Amps/sq. ft. | |
| Assay: Cr 56% Ni 10% Fe 34% | |
| EXAMPLE 2 | |
| Ammonium chloride | 100 g/l |
| Boric Acid | 30 g/l |
| Chromium chloride (Cr as metal) | 20 g/l |
| Nickel sulphate | 3 g/l |
| Ammonium sulphate | 30 g/l |
| Ferrous Ammonium sulphate | 3.5 g/l |
| Tartaric Acid | 25 g/l |
| Sodium Gluconate | 25 g/l |
| pH 2.5 | |
| Current Density 200 Amps/sq. ft | |
| Temperature 25° C. | |
| Assay Cr 53% Ni 12% Fe 35% | |
| EXAMPLE 3 | |
| Ammonium Chloride | 150 g/l |
| Boric acid | 40 g/l |
| Chromium chloride (Cr as metal) | 16 g/l |
| Nickel sulphate | 4 g/l |
| Ammonium sulphate | 35 g/l |
| Ferrous Ammonium sulphate | 2 g/l |
| Glycollic acid | 50 g/l |
| pH 2.5 | |
| Temperature 22° C. | |
| Current Density 200 Amps/sq. ft | |
| Assay Cr 54% Ni 12% Fe 34% | |
| EXAMPLE 4 | |
| Ammonium chloride | 150 g/l |
| Boric Acid | 40 g/l |
| Chromium chloride (Cr as metal) | 16 g/l |
| Nickel sulphate | 4 g/l |
| Ammonium sulphate | 35 g/l |
| Ferrous Ammonium sulphate | 2 g/l |
| Tartaric Acid | 25 g/l |
| Sodium Gluconate | 25 g/l |
| pH 2.5 | |
| Temperature 22° C. | |
| Current Density 200 Amps/sq. ft. | |
| Assay Cr 57% Ni 9% Fe 34% | |

Chromium content of the alloy coating can be increased by elevating the Chromium metal concentration of the electrolyte to 24–30 g/l, reducing the pH to 2.2 and increasing the plating current density to 300 amperes/sq.ft.

We have further discovered that a synergistic effect is achieved by using a nickel strike layer with co-deposited particles prior to deposition of chromium alloys, this effect being the surprising fineness of microdiscontinuities and elimination of macrocracks with a reduction in the internal stress of the coating.

This achieves a reduction of the internal stress to such extent that coatings can be achieved comparable in use to solid stainless steel articles combined with consistent high quality and appearance of the coating over the whole of the substrate.

By striking in the nickel particle electrolyte prior to deposition of chromium base alloy by the present invention a good microdiscontinuity is ensured over a wide range of thicknesses from 0.000015"–0.0001" without macrocracking.

With a coating of nickel followed by coating in the nickel particle electrolyte prior to deposition of the chromium alloy the composite coating of nickel and nickel strike (particles) and chromium alloy has a much lower internal stress than the same deposit missing out the nickel particle strike.

The alloy coating may be 0.00001 to 0.0001 inch and the nickel undercoating may be 0.0003 to 0.003 inch in thickness either as a single layer or composite layers.

Dependent upon the thickness of the nickel deposits used for coating of the base metal substrate i.e. whether 0.0003" or greater and whether a single layer nickel deposit or a composite layer, corrosion resistance could be varied from being equal to that of metallurgical stainless steel and surpassing that of metallurgical stainless steel, when said nickel coatings are overlaid with an electro-deposit of chromium alloy provided that the nickel coating prior to the stainless alloy coating contains co-deposited inert particles. The method of checking the corrosion resistance of the coatings using 18 Cr/8 Ni chromium alloy as a reference by subjecting to salt spray and copper accelerated salt spray (CASS).

Having found the chromium alloy coating on electrodeposited nickel could produce deposits having equal and in some cases superior corrosion resistance to metallurgical stainless steel further experiments were carried out using deposits of nickel-iron. U.S. Pat. No. 3,795,591 explains a method of depositing nickel-iron.

When applying composite nickel-iron coatings the first coating as with the nickel composite system has to be produced from a bath free from sulpho-oxygen compounds. A suitable bath is as listed in U.S. Pat. No. 3,795,591, column 8, lines 20–25. Using a bath of this nature the composite system as applied in the all nickel deposit system can be fully implemented merely by depositing nickel-iron from electrolytes that have no sulpho-oxygen compounds followed by nickel-iron deposits from electrolytes containing sulpho-oxygen compounds with or without inert particles. Provided that the layer preceding the chromium alloy coating contains co-deposited inert particles similar results in corrosion resistance were found when overlaying these nickel-iron substrates with chromium alloy to the all nickel system.

Furthermore a mixture of all the nickel and nickel-iron systems can be used and subsequently coated with chromium alloy. Again similar corrosion resistance was obtained. Tests were carried out using nickel followed by nickel-iron plus chromium alloy and nickel-iron followed by nickel plus chromium alloy, satisfactory corrosion resistance being obtained in all cases, provided that the nickel-nickel-iron, coating prior to the chromium alloy coating contains inert particles.

An alternative to the electro-deposited nickel and nickel-iron coatings prior to coating with chromium alloy is for the base metal substrate to be coated with a chemical produced nickel-phosphorous alloy, the principles of which are described in U.S. Pat. Nos. 2,532,283; 2,658,841; 2,658,842; 2,690,401 and 2,690,403 and are well known in the art.

Similarly coatings of thickness in excess of 0.0005" e.g. 0.0005 to 0.001 produced from using these techniques and subsequently coated with chromium alloy again exhibited excellent corrosion resistance.

Using this invention it is possible to produce chromium alloy electro-deposits which when applied on top of nickel, nickel-iron, nickel-phosphorous all of which may have inert particles co-deposited in the final nickel bearing coating prior to deposition of the chromium alloy coating stress free deposits with good corrosion resistance are obtained. The nickel coating will always contain at least 60% nickel.

Example of the electrolyte used for producing satin type nickel coatings containing inert particles:

| | |
|---|---|
| Nickel Sulphate | 100–300 g/l |
| Nickel Chloride | 30–250 g/l |
| Boric Acid | 30–40 g/l |
| Allyl Sulphonic Acid | 0.5–3.0 g/l |
| o-benzoyl sulphinimide | 1–2 g/l |
| p-toluene sulphonamide | 1–2 g/l |
| 2-butynoxy-1-4 diethoxyethane disulphonic acid | 0.1–2.0 g/l |
| Temperature | Room to 71° C. |
| Air or mechanical agitation | |
| pH | 3.0–5.2 |
| Particles e.g. Kaolin | 10–200 g/l |

As previously mentioned British Pat. No. 936172 and Canadian Pat. No. 689276 describe the use of finely divided inert particles in a nickel electrodeposited coating either to produce a satin-like finish or to produce micropores (as distinct from microcracking) in a covering layer of chromium. However this is no way suggested a solution for the problem of internal stress in chromium alloy coatings. It was indeed a very surprising discovery that with inert particles in the nickel undercoat the chromium alloy coatings were lower in stress and free from macrocracking and so firmly adherent to the substrate that the coated substrate would have the same characteristics of corrosion resistance as a solid stainless steel article.

The kind and quantity of inert particles however for electrodeposition of nickel underlying chromium alloy can be the same as indicated in the aforesaid prior patents.

The known use of an underlayer of nickel with particles for producing microporosity in a chromium layer in no way suggested that stress relief leading to the elimination of macrocracking would be achieved in a layer of chromium alloys.

A soluble ferrocyanide (e.g. potassium ferrocyanide) can sometimes usefully be included in the bath in quantities as specified in Patent Specification No. 1558760 e.g. about 0.5 to 1.5 ml e.g. 1 ml of about 15–25% e.g. 20% w/w ferrocyanide solution per liter of the bath for every 50 ppm trace metal contamination such as zinc and copper. However in the commercial scale testing this was unnecessary.

Commercial requirements for this technology are:

1. The plating is a bright clear finish over the whole of all significant surfaces of the article without blackish streakings and has an appearance similar to stainless steel.

2. The plating time is fairly short e.g. an adequate thickness of chromium alloy such as at least 0.0001 in not more than 10 minutes.

3. The current density does not exceed 30 amps per square decimeter as an average applied current density.

4. The temperature of the bath does not exceed 35° C.

5. The electroplating bath continues effective plating without constant attention for at least two days without adjusting the composition of the bath, and actually as long as seven days.

6. The coating is free from macrocracks and preferably has microporosity of some 10,000 pores per 100 mm. sq.

7. The coating is of approximately the same proportions of the elements over the plated surface area of the substrate provided that minimum current density on a significant current area does not fall below 15 amps/-square/dm.

Hexavalent chromium compounds heretofore commonly used in chrome electroplating baths were $CrO_3$, $K_2Cr_2O_7$ and $Na_2Cr_2O_7$.

For the present invention as used in all the Examples, the chromium compounds are trivalent e.g. $C^r{}_{23}$, $Cr^2(SO^4)^3.15H^2O$, $Cr^2(SO^4)^3.9H^2O$, $Cr^2(SO^4)^3(NH^4)SO^4.24H^2O$ and $CrCl^3.6H^2O$.

The Cr-Fe-Ni/Co alloy of the present invention lends itself effectively to the formation thereon of a passivating coating which may be produced on it by immersing the plated articles for about 1 to 2 minutes in an aqueous solution of potassium or sodium dichromate at pH 3-5 e.g., 4, a temperature of 30° to 50° C. e.g., 40° C., at about 30-50 amps sq/ft e.g., 40. (3.24-5.4 e.g. 4.32 amps/sq.dm).

The substrate is generally iron or steel e.g., mild steel but other substrates may also be coated.

I claim:

1. A method of coating a substrate wherein it is provided with a nickel coating upon which is electrodeposited an alloy consisting of 51 to 75% chromium, 5 to 15% nickel and/or cobalt and balance iron.

2. A method as claimed in claim 1 wherein the chromium is 55-65%, nickel 6-10%, balance iron.

3. A method as claimed in claim 1 or 2 wherein the nickel coating is a composite layer of columnar type nickel followed by a layer of lamellar nickel.

4. A method as claimed in claim 1 wherein the nickel coating also contains iron or phosphorous.

5. A method as claimed in claim 1 wherein the nickel coating contains inert particles.

6. A method as claimed in claim 1 wherein the chromium alloy coating is 0.00001 to 0.0001 inch and the nickel is 0.0003 to 0.003 inch in thickness.

7. A method as claimed in claim 1 wherein the chromium coating is produced from an electrolytic bath in which the chromium is in the trivalent form.

8. A method as claimed in claim 1 wherein the coated substrate is treated in a solution of potassium or sodium dichromate at pH 3-5, a temperature of 30°-50°, at 30-50 amps/sq. ft.

* * * * *